US010472973B2

(12) United States Patent
Dutta et al.

(10) Patent No.: US 10,472,973 B2
(45) Date of Patent: Nov. 12, 2019

(54) TURBINE COMPONENT AND METHODS OF MAKING AND COOLING A TURBINE COMPONENT

(71) Applicant: GENERAL ELECTRIC COMPANY, Schenectady, NY (US)

(72) Inventors: Sandip Dutta, Greenville, SC (US); James Zhang, Greenville, SC (US); Gary Michael Itzel, Simpsonville, SC (US); John McConnell Delvaux, Fountain Inn, SC (US); Matthew Troy Hafner, Honea Path, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 667 days.

(21) Appl. No.: 15/174,271

(22) Filed: Jun. 6, 2016

(65) Prior Publication Data

US 2017/0350260 A1 Dec. 7, 2017

(51) Int. Cl.
*F01D 5/18* (2006.01)
*F01D 9/02* (2006.01)
(Continued)

(52) U.S. Cl.
CPC ..... *F01D 5/187* (2013.01); *F01D 5/147* (2013.01); *F01D 5/282* (2013.01); *F01D 9/02* (2013.01); *F01D 25/12* (2013.01); *F05D 2220/30* (2013.01); *F05D 2230/22* (2013.01); *F05D 2230/237* (2013.01); *F05D 2230/31* (2013.01); *F05D 2240/122* (2013.01);
(Continued)

(58) Field of Classification Search
CPC ..... F01D 5/187; F01D 25/12; F01D 5/282; F01D 5/147; F01D 9/02; F05D 2300/6033; F05D 2260/204; F05D 2230/31; F05D 2250/184; F05D 2230/22; F05D 2220/30; F05D 2230/237; F05D 2260/20; F05D 2240/122; F05D 2240/304; F05D 2250/183; F05D 2250/185; F05D 2300/175
See application file for complete search history.

(56) References Cited

U.S. PATENT DOCUMENTS 3,533,712 A 10/1970 Kercher
3,736,071 A 5/1973 Kydd
(Continued)

OTHER PUBLICATIONS

Extended European Search Report and Opinion issued in connection with corresponding EP Application No. 17174321.4 dated Oct. 6, 2017.

*Primary Examiner* — Eldon T Brockman
(74) *Attorney, Agent, or Firm* — McNees Wallace & Nurick LLC

(57) ABSTRACT

A turbine component includes a root and an airfoil extending from the root to a tip opposite the root. The airfoil forms a leading edge and a trailing edge portion extending to a trailing edge. Radial cooling channels in the trailing edge portion of the airfoil permit radial flow of a cooling fluid through the trailing edge portion. Each radial cooling channel has a first end at a lower surface at a root edge of the trailing edge portion or at an upper surface at a tip edge of the trailing edge portion and a second end opposite the first end at the lower surface or the upper surface. A method of making a turbine component and a method of cooling a turbine component are also disclosed.

16 Claims, 5 Drawing Sheets

(51) Int. Cl.
*F01D 25/12* (2006.01)
*F01D 5/14* (2006.01)
*F01D 5/28* (2006.01)

(52) U.S. Cl.
CPC .. *F05D 2240/304* (2013.01); *F05D 2250/183* (2013.01); *F05D 2250/184* (2013.01); *F05D 2250/185* (2013.01); *F05D 2260/20* (2013.01); *F05D 2260/204* (2013.01); *F05D 2300/175* (2013.01); *F05D 2300/6033* (2013.01)

(56) References Cited

U.S. PATENT DOCUMENTS 4,214,355 A * 7/1980 Zelahy ..... F01D 5/005 228/182
5,246,340 A * 9/1993 Winstanley ..... B23P 15/04 415/115
6,331,217 B1 * 12/2001 Burke ..... B23H 9/10 148/522
6,514,046 B1 * 2/2003 Morrison ..... F01D 5/187 416/229 A
7,670,113 B1 3/2010 Liang
7,862,299 B1 * 1/2011 Liang ..... F01D 5/147 416/97 R
9,347,320 B2 * 5/2016 Gustafson ..... F01D 5/02
2003/0059577 A1 3/2003 Morrison et al.
2006/0222493 A1 * 10/2006 Liang ..... F01D 5/187 416/97 R
2009/0193657 A1 * 8/2009 Wilson, Jr. ..... F01D 5/147 29/889.721
2013/0108460 A1 * 5/2013 Szwedowicz ..... B22F 3/1055 416/241 R
2015/0107266 A1 * 4/2015 Gustafson ..... F01D 5/02 60/805
2016/0082547 A1 * 3/2016 Szwedowicz ..... B22F 3/1055 700/98

* cited by examiner

TURBINE COMPONENT AND METHODS OF MAKING AND COOLING A TURBINE COMPONENT

STATEMENT REGARDING FEDERALLY SPONSORED RESEARCH

This invention was made with Government support under contract number DE-FE0024006 awarded by the Department of Energy. The Government has certain rights in the invention.

FIELD OF THE INVENTION

The present embodiments are directed to methods and devices for cooling the trailing edge portion of a turbine airfoil. More specifically, the present embodiments are directed to methods and devices including a turbine component with radial cooling channels along the trailing edge.

BACKGROUND OF THE INVENTION

Modern high-efficiency combustion turbines have firing temperatures that exceed about 2000° F. (1093° C.), and firing temperatures continue to increase as demand for more efficient engines continues. Gas turbine components, such as nozzles and blades, are subjected to intense heat and external pressures in the hot gas path. These rigorous operating conditions are exacerbated by advances in the technology, which may include both increased operating temperatures and greater hot gas path pressures. As a result, components, such as nozzles and blades, are sometimes cooled by flowing a fluid through a manifold inserted into the core of the nozzle or blade, which exits the manifold through impingement holes into a post-impingement cavity, and which then exits the post-impingement cavity through apertures in the exterior wall of the nozzle or blade, in some cases forming a film layer of the fluid on the exterior of the nozzle or blade.

The cooling of the trailing edge of a turbine airfoil is important to prolong its integrity in the hot furnace-like environment. While turbine airfoils are often made primarily of a nickel-based or a cobalt-based superalloy, turbine airfoils may alternatively have an outer portion made of one or more ceramic matrix composite (CMC) materials. CMC materials are generally better at handling higher temperatures than metals. Certain CMC materials include compositions having a ceramic matrix reinforced with coated fibers. The composition provides strong, lightweight, and heat-resistant materials with possible applications in a variety of different systems. The materials from which turbine components, such as nozzles and blades, are formed, combined with the particular conformations which the turbine components include, lead to certain inhibitions in the cooling efficacy of the cooling fluid systems. Maintaining a substantially uniform temperature of a turbine airfoil maximizes the useful life of the airfoil.

The manufacture of a CMC part typically includes laying up pre-impregnated composite fibers having a matrix material already present (prepreg) to form the geometry of the part (pre-form), autoclaving and burning out the pre-form, infiltrating the burned-out pre-form with the melting matrix material, and any machining or further treatments of the pre-form. Infiltrating the pre-form may include depositing the ceramic matrix out of a gas mixture, pyrolyzing a pre-ceramic polymer, chemically reacting elements, sintering, generally in the temperature range of 925 to 1650° C. (1700 to 3000° F.), or electrophoretically depositing a ceramic powder. With respect to turbine airfoils, the CMC may be located over a metal spar to form only the outer surface of the airfoil.

Examples of CMC materials include, but are not limited to, carbon-fiber-reinforced carbon (C/C), carbon-fiber-reinforced silicon carbide (C/SiC), silicon-carbide-fiber-reinforced silicon carbide (SiC/SiC), alumina-fiber-reinforced alumina ($Al_2O_3/Al_2O_3$), or combinations thereof. The CMC may have increased elongation, fracture toughness, thermal shock, dynamic load capability, and anisotropic properties as compared to a monolithic ceramic structure.

BRIEF DESCRIPTION OF THE INVENTION

In an embodiment, a turbine component includes a root and an airfoil extending from the root to a tip opposite the root. The airfoil forms a leading edge and a trailing edge portion extending to a trailing edge. A plurality of radial cooling channels in the trailing edge portion of the airfoil permit radial flow of a cooling fluid through the trailing edge portion. Each radial cooling channel has a first end at a lower surface at a root edge of the trailing edge portion or at an upper surface at a tip edge of the trailing edge portion and a second end opposite the first end at the lower surface or the upper surface.

In another embodiment, a method of making a turbine component includes forming an airfoil having a leading edge, a trailing edge portion extending to a trailing edge, and a plurality of radial cooling channels in the trailing edge portion. The radial cooling channels permit radial flow of a cooling fluid through the trailing edge portion. Each radial cooling channel has a first end at a lower surface at a root edge of the trailing edge portion or at an upper surface at a tip edge of the trailing edge portion and a second end opposite the first end at the lower surface or the upper surface.

In another embodiment, a method of cooling a turbine component includes supplying a cooling fluid to an interior of the turbine component. The turbine component includes a root and an airfoil extending from the root to a tip opposite the root. The airfoil forms a leading edge and a trailing edge portion extending to a trailing edge. The trailing edge portion has a plurality of radial cooling channels arranged to permit radial flow of a cooling fluid through the trailing edge portion. Each radial cooling channel has a first end at a lower surface at a root edge of the trailing edge portion or at an upper surface at a tip edge of the trailing edge portion and a second end opposite the first end at the lower surface or the upper surface. The method also includes directing the cooling fluid through the radial cooling channels through the trailing edge portion of the airfoil.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is a method and a device for cooling the trailing edge of a turbine airfoil with radial cooling channels along the trailing edge portion of the turbine airfoil.

Embodiments of the present disclosure, for example, in comparison to concepts failing to include one or more of the features disclosed herein, provide cooling in a turbine airfoil, provide a more uniform temperature in a cooled turbine airfoil, provide a turbine airfoil with an enhanced lifespan, or combinations thereof.

As used herein, radial refers to orientation directionally between a first surface, such as lower surface 52, at a lower radial height and a second surface, such as upper surface 56, at a higher radial height from the axis of the turbine.

As used herein, a trailing edge portion refers to a portion of an airfoil at the trailing edge without chambers or other void space aside from the cooling channels formed therein, as described herein.

Figure 1:
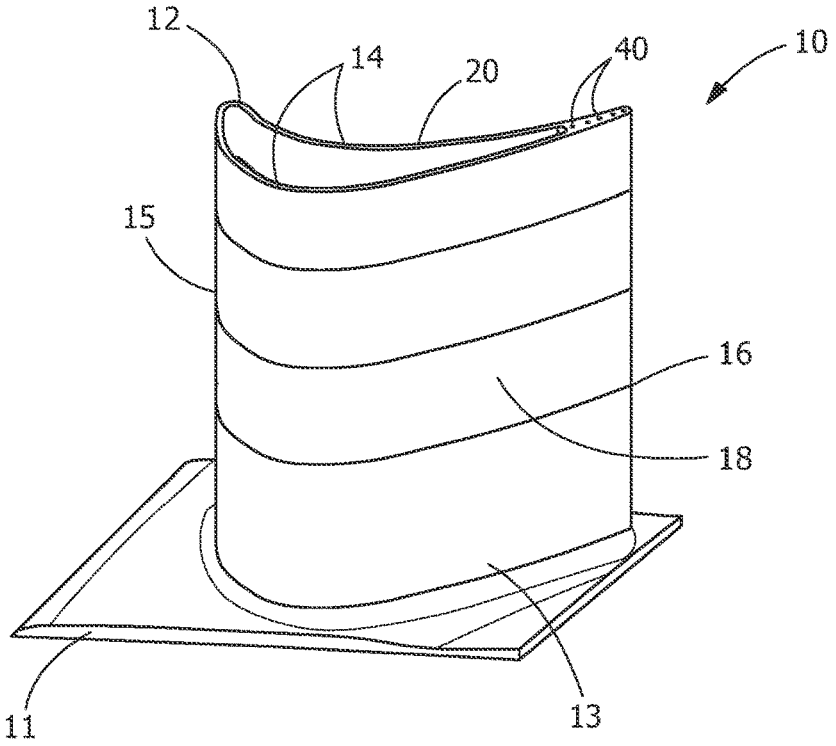
FIG. 1 is a schematic perspective side view of a turbine component in an embodiment of the present disclosure.

Referring to FIG. 1, a turbine component 10 includes a root 11 and an airfoil 12 extending from the root 11 at the base 13 to a tip 14 opposite the base 13. In some embodiments, the turbine component 10 is a turbine nozzle. In some embodiments, the turbine component 10 is a turbine blade. The shape of the airfoil 12 includes a leading edge 15, a trailing edge 16, a suction side 18 having a convex outer surface, and a pressure side 20 having a concave outer surface opposite the convex outer surface. Although not shown in FIG. 1, the turbine component 10 may also include an outer sidewall at the tip 14 of the airfoil 12 similar to the root 11 at the base 13 of the airfoil 12.

Figure 2:
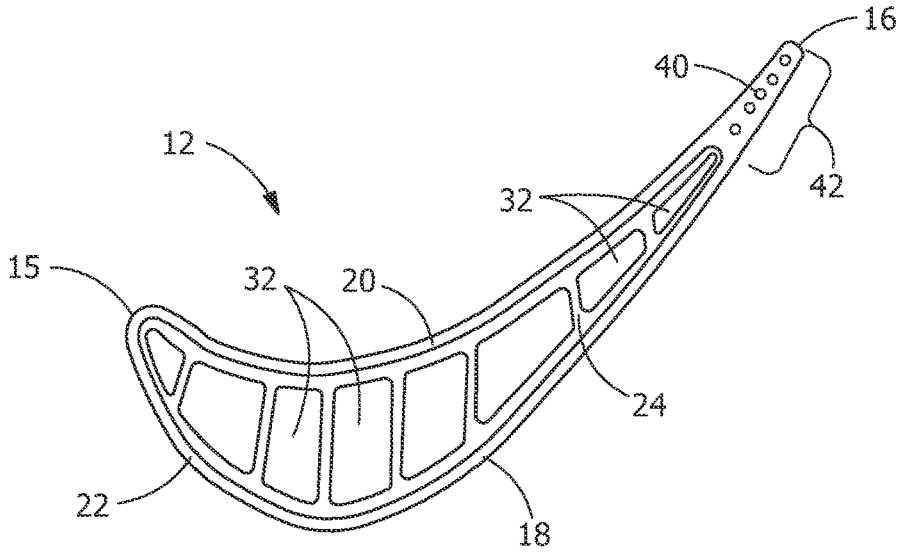
FIG. 2 is a schematic top view of the turbine component of FIG. 1 with a CMC outer layer.
Figure 3:
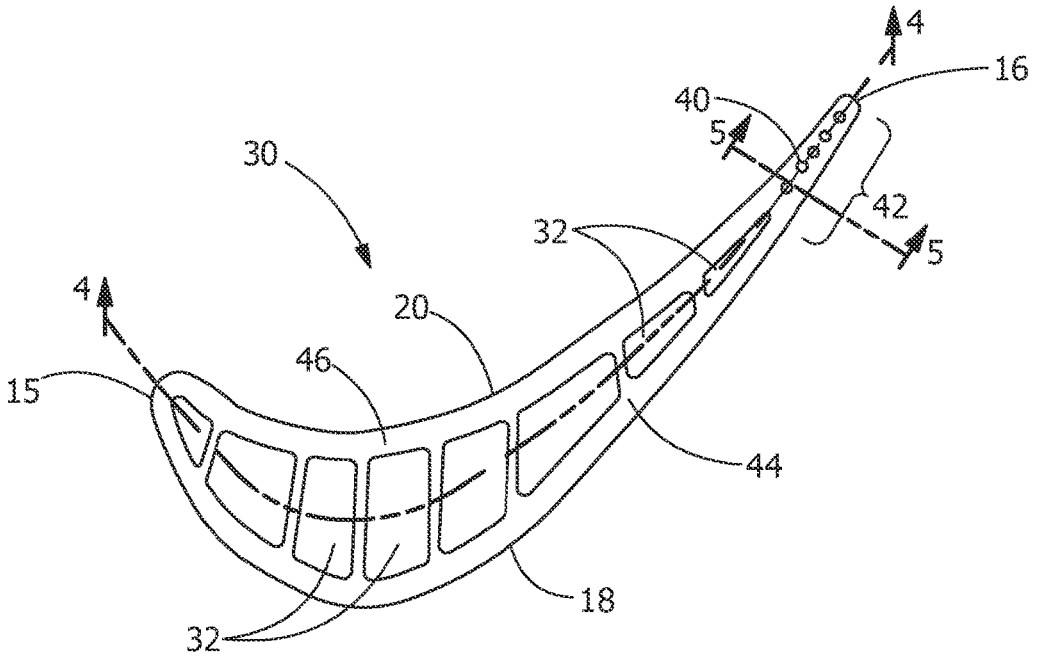
FIG. 3 is a schematic top view of the turbine component of FIG. 1 as a metal airfoil.

The generally arcuate contour of the airfoil 12 is shown more clearly in FIG. 2 and FIG. 3. Referring to FIG. 2, the airfoil 12 includes a ceramic matrix composite (CMC) shell 22 mounted on a metal spar 24. The airfoil 12 is formed as a thin CMC shell 22 of one or more layers of CMC materials over the metal spar 24. Initial thermal analysis indicates that the trailing edge portion of the CMC shell 22 of a turbine airfoil gets hot and cooling may be necessary to preserve the structural integrity. Referring to FIG. 3, the airfoil 12 is alternatively formed as a metal part 30. The metal part is preferably a high-temperature superalloy. In some embodiments, the high-temperature superalloy is a nickel-based high-temperature superalloy or a cobalt-based high-temperature superalloy.

In either case, the radial cooling channels 40 in the trailing edge portion 42 permit a cooling fluid supplied to the lower portion at the base 13 and/or the upper portion at the tip 14 of the trailing edge portion 42 at the base 13 to flow through at least a portion of the trailing edge portion 42 and out of the lower portion at the base 13 or the upper portion at the tip 14 of the trailing edge portion 42 during operation of a turbine including the turbine component 10. The airfoil 12 also includes one or more chambers 32 to which cooling fluid may be provided by way of the root 11 or by way of the tip 14 of the turbine component 10.

Referring to FIG. 4 through FIG. 11, the trailing edge portion 42 of the turbine component 10 includes the radial cooling channels 40 that open at a first end 50 at a lower surface 52 and a second end 54 opposite the first end 50 at an upper surface 56 to provide passage of a cooling fluid in a generally radial direction through the trailing edge portion 42 of the turbine component 10.

Figure 12:
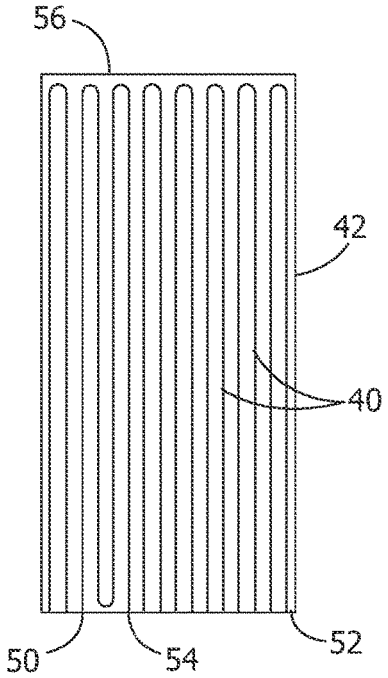
FIG. 12 is a schematic partial cross sectional view of the trailing edge portion of the turbine component of FIG. 1 showing a radial cooling channel arrangement with both ends at the lower surface in an embodiment of the present disclosure.

Referring to FIG. 12, the trailing edge portion 42 of the turbine component 10 includes the radial cooling channels 40 that open at a first end 50 at a lower surface 52 and a second end 54 opposite the first end 50 at the lower surface 52 to provide passage of a cooling fluid through the trailing edge portion 42 of the turbine component 10.

Figure 13:
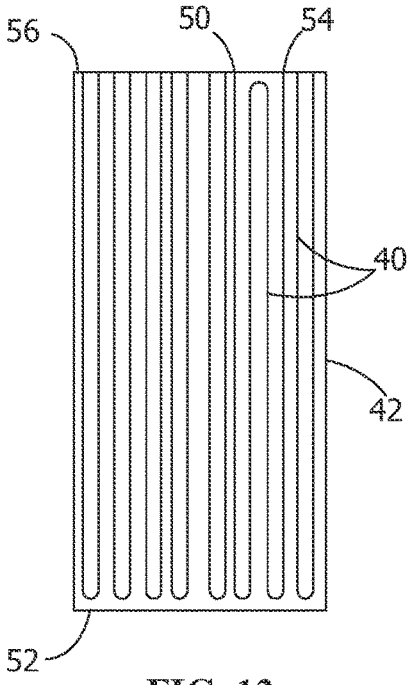
FIG. 13 is a schematic partial cross sectional view of the trailing edge portion of the turbine component of FIG. 1 showing a radial cooling channel arrangement with both ends at the upper surface in an embodiment of the present disclosure.

Referring to FIG. 13, the trailing edge portion 42 of the turbine component 10 includes the radial cooling channels 40 that open at a first end 50 at an upper surface 56 and a second end 54 opposite the first end 50 at the upper surface 56 to provide passage of a cooling fluid through the trailing edge portion 42 of the turbine component 10.

Figure 14:
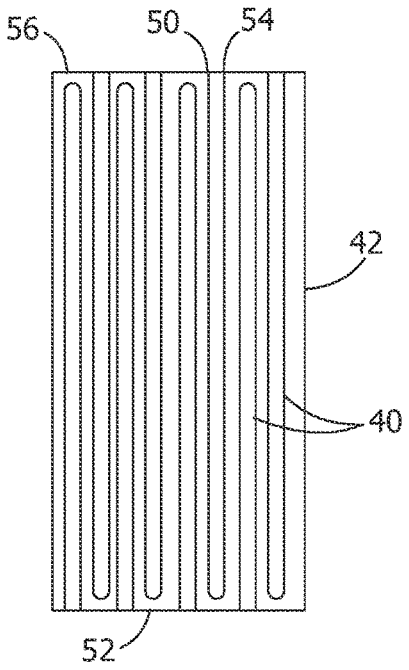
FIG. 14 is a schematic partial cross sectional view of the trailing edge portion of the turbine component of FIG. 1 showing a radial cooling channel arrangement with some channels having both ends at the lower surface and some channels having both ends at the upper surface in an embodiment of the present disclosure.

Referring to FIG. 14, the trailing edge portion 42 of the turbine component 10 includes some radial cooling channels 40 that open at a first end 50 at a lower surface 52 and a second end 54 opposite the first end 50 at the lower surface 52 and some radial cooling channels 40 that open at a first end 50 at an upper surface 56 and a second end 54 opposite the first end 50 at the upper surface 56 to provide passage of a cooling fluid through the trailing edge portion 42 of the turbine component 10. This counter flowing design compensates for heat pick up along the length of the cooling circuit in that as an up pass radial cooling channel 40 picks up heat and becomes less efficient near its end of the circuit is compensated by the counter flowing circuit radial cooling channel 40 having little heat pick up, making the system more efficient.

In some embodiments, the radial cooling channels 40 are formed substantially along the line 4-4 of the trailing edge portion 42, such as shown in FIG. 4 and FIG. 6 through FIG. 14. In other embodiments, the radial cooling channels 40 may lie off the line 4-4 of the trailing edge portion 42 or extend into either the first section 44 or the second section 46 of the airfoil 12. Any of the contours disclosed herein may be arranged in either manner. As shown in FIG. 5, the contours of the radial cooling channels 40 may be staggered such that neighboring radial cooling channels 40 are different distances from the surfaces of the trailing edge portion 42 at the same radial distance from the turbine axis.

Figure 4:
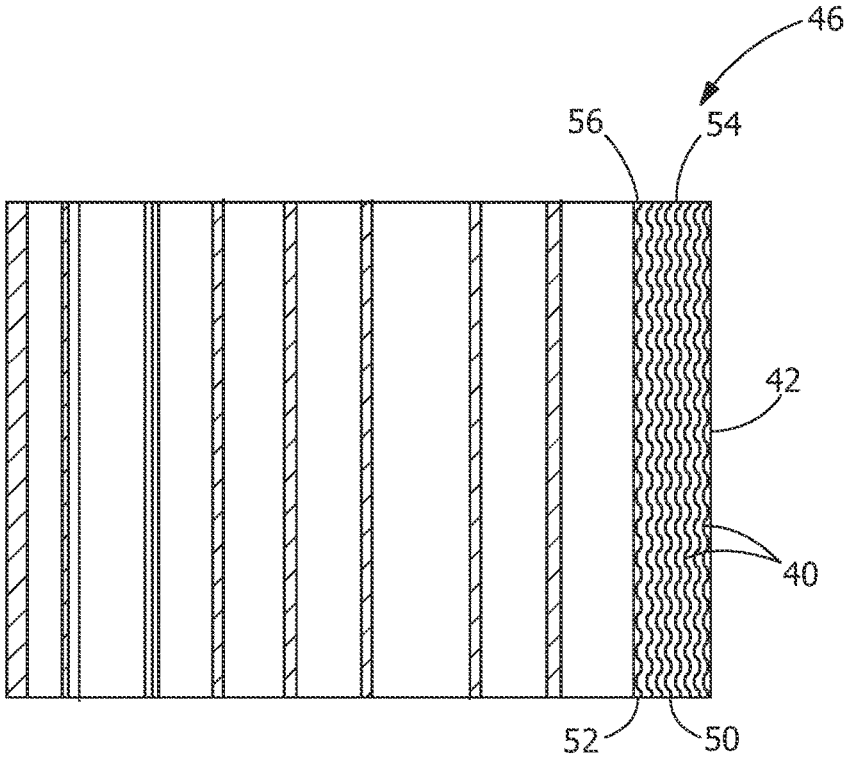
FIG. 4 is a schematic partial cross sectional view taken along line 4-4 of FIG. 3 showing a waving cooling channel arrangement in an embodiment of the present disclosure.
Figure 5:
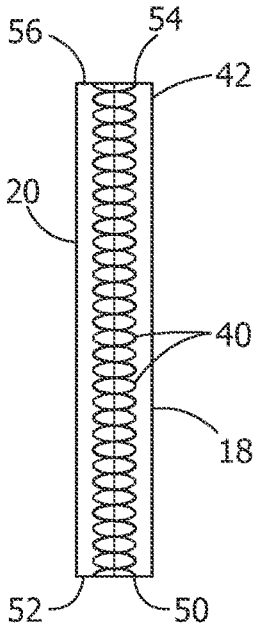
FIG. 5 is a schematic partial cross sectional view taken along line 5-5 of FIG. 3 showing a waving cooling channel arrangement in an embodiment of the present disclosure.
Figure 6:
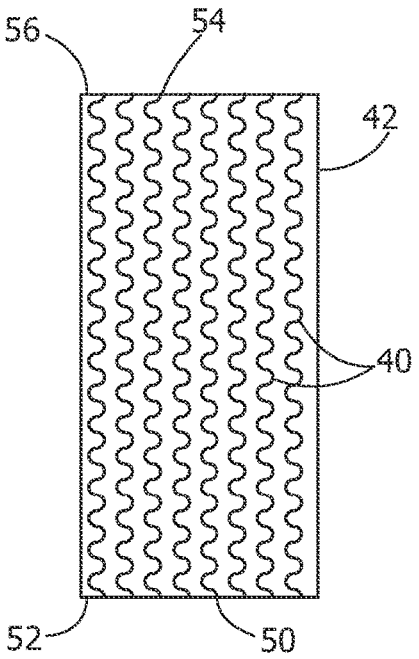
FIG. 6 is a schematic partial cross sectional view of the trailing edge portion of the turbine component of FIG. 1 showing a wavy cooling channel arrangement in an embodiment of the present disclosure.
Figure 7:
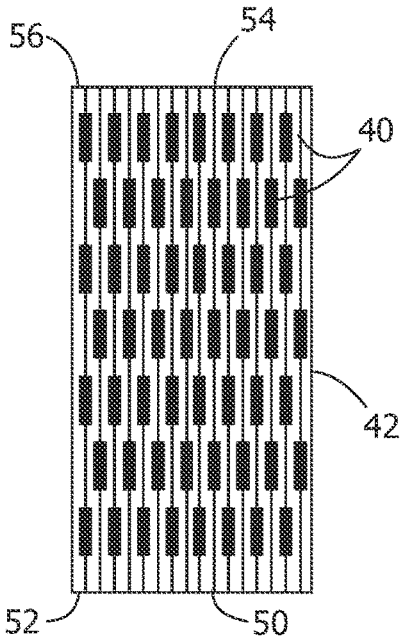
FIG. 7 is a schematic partial cross sectional view of the trailing edge portion of the turbine component of FIG. 1 showing a cooling channel arrangement with variable cross sectional area channels in an embodiment of the present disclosure.
Figure 8:
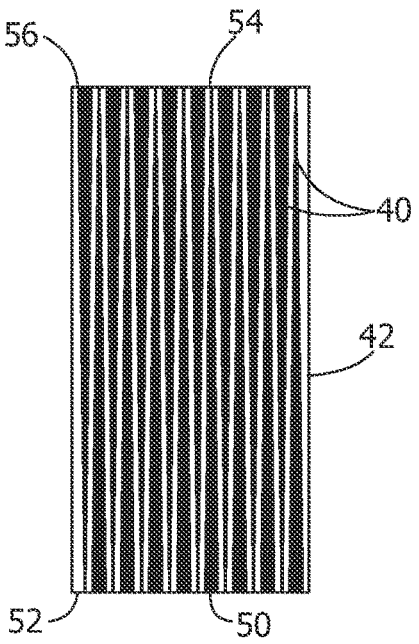
FIG. 8 is a schematic partial cross sectional view of the trailing edge portion of the turbine component of FIG. 1 showing a cooling channel arrangement with tapering cross sectional area channels in an embodiment of the present disclosure.
Figure 9:
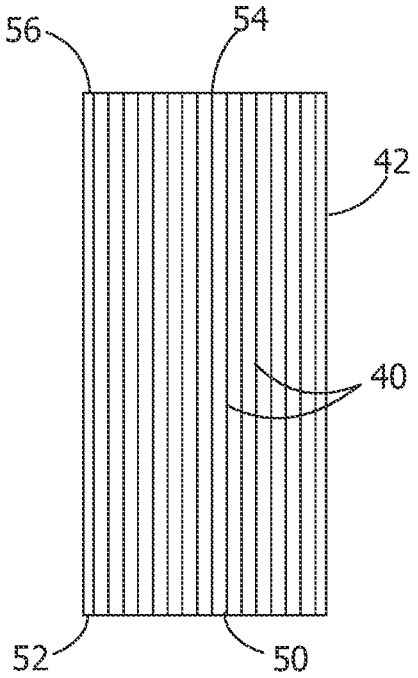
FIG. 9 is a schematic partial cross sectional view of the trailing edge portion of the turbine component of FIG. 1 showing a straight cooling channel arrangement in an embodiment of the present disclosure.
Figure 10:
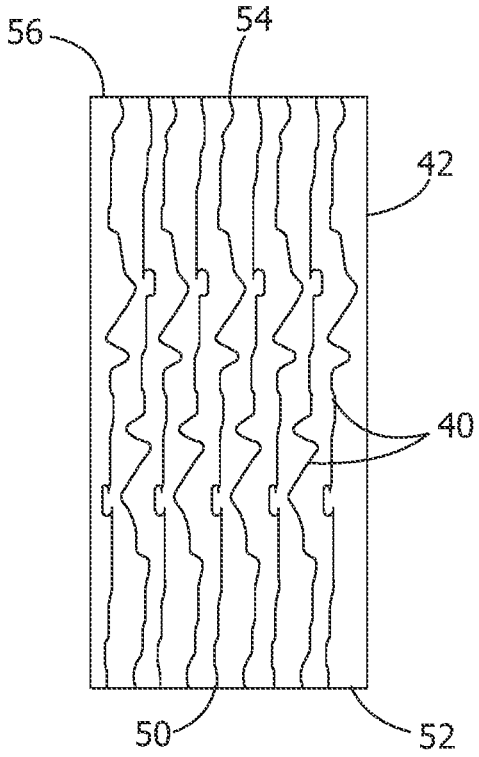
FIG. 10 is a schematic partial cross sectional view of the trailing edge portion of the turbine component of FIG. 1 showing an irregular cooling channel arrangement in an embodiment of the present disclosure.
Figure 11:
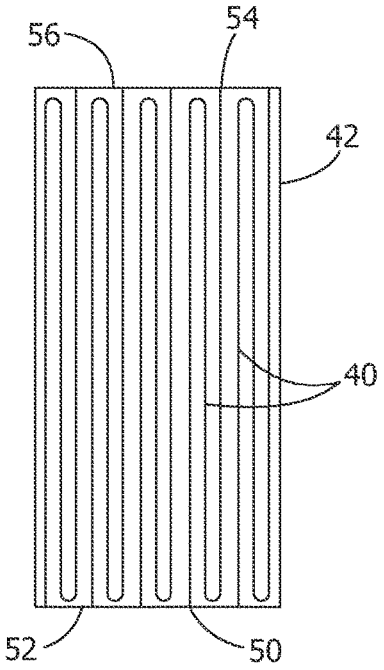
FIG. 11 is a schematic partial cross sectional view of the trailing edge portion of the turbine component of FIG. 1 showing a serpentine cooling channel arrangement in an embodiment of the present disclosure.

The radial cooling channels 40 in the trailing edge portion 42 may have any geometry, including, but not limited to, a wavy contour as shown in FIG. 4 through FIG. 6, a serpentine contour as shown in FIG. 11 through FIG. 14, a contour of abruptly varying cross sectional areas as shown in FIG. 7, a contour of tapering cross sectional area as shown in FIG. 8, a straight contour as shown in FIG. 9, an irregular contour as shown in FIG. 10, or combinations thereof. An irregular contour may be any non-repeating contour, such as, for example, a random contour. The formation of the airfoil 12 from two sections 44, 46 permits formation of radial cooling channels 40 with complex contours.

The varying cross sectional areas of the radial cooling channels 40 of FIG. 7 promote greater heat transfer to the cooling fluid by promoting mixing of the cooling fluid. In some embodiments, the radial cooling channels 40 may be formed in the trailing edge portion 42 after the formation of the airfoil 12. In some embodiments, the radial cooling channels 40 are formed by stem drilling. In other embodiments, the radial cooling channels 40 have a geometry that prevents their formation by stem drilling.

The tapering cross sectional areas of the radial cooling channels 40 of FIG. 8 compensate for the increase in volume of the cooling fluid while picking up heat along the radial cooling channel 40 as the cooling fluid flows through a radial cooling channel 40. The tapering cross sectional areas may help to maintain a similar heat transfer pattern along the radial cooling channel 40. As such, the tapering is preferably in the direction opposite of the cooling fluid flow. The taper orientation may be in either direction, such as the alternating directions shown in FIG. 8 or the same direction.

The cross section of a radial cooling channel 40 may have any shape, including, but not limited to, a round shape, an elliptical shape, a racetrack shape, and a parallelogram. The size and shape of the cross section of the radial cooling channel 40 may vary from the first end 50 to the second end 54, depending on the local cooling effectiveness required of the channel. The walls of the radial cooling channel 40 may be smooth or may have one or more features to augment the internal heat transfer coefficients by disrupting the boundary layer flow, such as by turbulators located locally or all along the length of the radial cooling channel 40.

When the airfoil 12 includes a CMC shell 22, at least a portion of the radial cooling channels 40 may be formed between layers of the CMC material. In some embodiments, all of the radial cooling channels 40 are formed between CMC layers. In some embodiments, the radial cooling channels 40 are formed by machining the CMC material after formation of the CMC material. In other embodiments, a sacrificial material is burned or pyrolyzed out either during or after formation of the CMC material to form the radial cooling channels 40. In some embodiments, the CMC shell 22 is made as two parts and glued together to form the trailing edge portion 42.

When the airfoil 12 is formed as a metal part 30, the metal part may be formed by casting or alternatively by metal three-dimensional (3D) printing. In some embodiments, the metal part 30 is formed as two metal pieces that are brazed or welded together, such as, for example, along line 4-4 of FIG. 3. In such embodiments, the two pieces are a first section 44 including the suction side 18 having the convex outer surface and a second section 46 including the pressure side 20 having the concave outer surface, with at least a portion of the radial cooling channels 40 being formed at one or both of the surfaces of the sections 44, 46. In some embodiments, all of the radial cooling channels 40 are formed at the surface of the sections 44, 46. In other embodiments, the metal part 30 may be formed as a single piece by metal 3D printing.

Metal 3D printing enables precise creation of a turbine component 10 including complex radial cooling channels 40. In some embodiments, metal 3D printing forms successive layers of material under computer control to create at least a portion of the turbine component 10. In some embodiments, powdered metal is heated to melt or sinter the powder to the growing turbine component 10. Heating methods may include, but are not limited to, selective laser sintering (SLS), direct metal laser sintering (DMLS), selective laser melting (SLM), electron beam melting (EBM), and combinations thereof. In some embodiments, a 3D metal printer lays down metal powder, and then a high-powered laser melts that powder in certain predetermined locations based on a model from a computer-aided design (CAD) file. Once one layer is melted and formed, the 3D printer repeats the process by placing additional layers of metal powder on top of the first layer or where otherwise instructed, one at a time, until the entire metal component is fabricated.

The radial cooling channels 40 are preferably formed in the trailing edge portion 42 of the airfoil 12 to permit passage of a cooling fluid to cool the trailing edge portion 42. The radial cooling channels 40 may have any contour that provides passage of a cooling fluid in a generally radial direction, including, but not limited to, wavy, serpentine, varying cross sectional areas, straight, or combinations thereof.

In some embodiments, the dimensions, contours, and/or locations of the radial cooling channels 40 are selected to permit cooling that maintains a substantially uniform temperature in the trailing edge portion 42 during operation of a turbine including the turbine component 10.

Radial cooling channels 40 along the trailing edge 16 of the airfoil 12 provide passageways for cooling fluid generally in the radial direction with respect to the turbine rotor. The radial cooling channels 40 may have any geometry, including, but not limited to, straight radial holes that may include stem-drilled holes, complex geometries such as serpentine or wavy, or combinations thereof. More complex geometries than stem-drilled holes may be accommodated in the trailing edge portion, benefitting heat transfer and uniform temperature distribution in the airfoil 12. In some embodiments, the radial cooling channels 40 have variations in the cross sectional area of the radial cooling channel 40, with portions of different cross sectional area along the length of the radial cooling channels 40. In some embodiments, the radial cooling channels 40 are staggered perpendicular to the turbine axis with some near the surface and some buried farther beneath the surface.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. A turbine component comprising:

a root; and an airfoil extending from the root to a tip opposite the root, the airfoil forming a leading edge and a trailing edge portion extending to a trailing edge;

wherein a plurality of radial cooling channels in the trailing edge portion of the airfoil are arranged to permit radial flow of a cooling fluid through the trailing edge portion, each radial cooling channel having a first end at a lower surface at a root edge of the trailing edge portion or at an upper surface at a tip edge of the trailing edge portion and a second end opposite the first end at the lower surface or the upper surface; and wherein the airfoil comprises a first section and a second section, the first section and the second section being formed by metal three-dimensional printing and at least a portion of the plurality of radial cooling channels being formed at a formed surface of the first section or the second section.

2. The turbine component of claim 1, wherein the airfoil is formed of a high-temperature superalloy.

3. The turbine component of claim 2, wherein the second section is brazed to the first section to form the airfoil.

4. The turbine component of claim 2, wherein the second section is welded to the first section to form the airfoil.

5. The turbine component of claim 1, wherein the plurality of radial cooling channels have a radial geometry selected from the group consisting of wavy, serpentine, straight, irregular, and combinations thereof.

6. The turbine component of claim 1, wherein at least one of the plurality of radial cooling channels comprises at least one first span having a first cross sectional area and at least one second span having a second cross sectional area greater than the first cross sectional area.

7. A method of making a turbine component comprising:

forming an airfoil having a leading edge, a trailing edge portion extending to a trailing edge, and a plurality of radial cooling channels in the trailing edge portion, the plurality of radial cooling channels being arranged to permit radial flow of a cooling fluid through the trailing edge portion, each radial cooling channel having a first end at a lower surface at a root edge of the trailing edge portion or at an upper surface at a tip edge of the trailing edge portion and a second end opposite the first end at the lower surface or the upper surface;

wherein the forming comprises metal three-dimensionally printing a first section and a second section of the airfoil, at least a portion of the plurality of radial cooling channels being formed at a formed surface of the first section or the second section.

8. The method of claim 7, wherein the forming further comprises brazing the first section to the second section to form the airfoil.

9. The method of claim 7, wherein the forming comprises metal three-dimensional printing of a high-temperature superalloy to form the airfoil.

10. The method of claim 7, wherein the forming further comprises welding the first section to the second section to form the airfoil.

11. The method of claim 7, wherein the plurality of radial cooling channels have a geometry selected from the group consisting of wavy, serpentine, straight, and combinations thereof.

12. A method of cooling a turbine component comprising:

supplying a cooling fluid to an interior of the turbine component, the turbine component comprising:

a root; and an airfoil extending from the root to a tip opposite the root, the airfoil forming a leading edge and a trailing edge portion extending to a trailing edge, the trailing edge portion having a plurality of radial cooling channels arranged to permit radial flow of a cooling fluid through the trailing edge portion, each radial cooling channel having a first end at a lower surface at a root edge of the trailing edge portion or at an upper surface at a tip edge of the trailing edge portion and a second end opposite the first end at the lower surface or the upper surface; and directing the cooling fluid through the plurality of radial cooling channels through the trailing edge portion of the airfoil;

wherein the airfoil comprises a first section and a second section, the first section and the second section being formed by metal three-dimensional printing and at least a portion of the plurality of radial cooling channels being formed at a formed surface of the first section or the second section.

13. The method of claim 12 further comprising operating a turbine comprising the turbine component.

14. The method of claim 12, wherein the airfoil is formed of a high-temperature superalloy.

15. The method of claim 14, wherein the second section is welded to the first section to form the airfoil.

16. The method of claim 14, wherein the second section is brazed to the first section to form the airfoil.

* * * * *